US010189671B2

(12) United States Patent
Kache et al.

(10) Patent No.: US 10,189,671 B2
(45) Date of Patent: Jan. 29, 2019

(54) DEVICE AND METHOD FOR THE SUBSEQUENT PROCESSING OF PRINTED PRODUCTS

(71) Applicant: Müller Martini Holding AG, Hergiswil (CH)

(72) Inventors: Gerd Kache, Lohne (DE); Stefan Winkelmann, Warmsen (DE)

(73) Assignee: Muller Martini Holding AG, Hergiswil (CH)

( * ) Notice: Subject to any disclaimer, the term of this patent is extended or adjusted under 35 U.S.C. 154(b) by 0 days.

(21) Appl. No.: 15/589,030

(22) Filed: May 8, 2017

(65) Prior Publication Data

US 2017/0341888 A1 Nov. 30, 2017

(30) Foreign Application Priority Data

May 30, 2016 (DE) ..... 10 2016 006 377

(51) Int. Cl.
*B65H 43/02* (2006.01)
*B65H 7/02* (2006.01)
(Continued)

(52) U.S. Cl.
CPC ..... *B65H 43/02* (2013.01); *B41F 13/54* (2013.01); *B41F 23/00* (2013.01);
(Continued)

(58) Field of Classification Search
CPC ..... B42C 19/08; B41F 33/00; B41F 33/02; B65H 7/00; B65H 7/02; B65H 7/04;
(Continued)

(56) References Cited

U.S. PATENT DOCUMENTS 3,966,197 A * 6/1976 Riedl ..... B65H 3/0808 271/103
4,176,941 A * 12/1979 Breitenkam ..... B65H 7/02 271/259

(Continued)

FOREIGN PATENT DOCUMENTS

DE 102010046328 A1 3/2012
EP 1481598 A1 12/2004
EP 1952986 A1 11/2014

OTHER PUBLICATIONS

Espacenet machine translation of DE102010046328; obtained Mar. 8, 2018; http://translationportal.epo.org/emtp/translate/?ACTION=description-retrieval&COUNTRY=DE&ENGINE=google&FORMAT=docdb&KIND=A1&LOCALE=en_EP&NUMBER= 102010046328 &OPS=ops.epo.org/3.2&SRCLANG=de&TRGLANG=en.*

(Continued)

*Primary Examiner* — Leslie A Nicholson, III
(74) *Attorney, Agent, or Firm* — Alix, Yale & Ristas, LLP

(57) ABSTRACT

A device and method for the processing of printed products with one or more transport systems for transporting the printed products between processing stations comprises a transport path lighting system that is divided into segments, wherein the type of illumination of such a segment is with respect to its color, intensity and/or variation in time defined by certain properties of the product located in this section or its production history.

19 Claims, 2 Drawing Sheets

(51) Int. Cl.

| | |
|---|---|
| ***B65H 7/04*** | (2006.01) |
| ***B65H 7/14*** | (2006.01) |
| ***B65H 7/06*** | (2006.01) |
| ***B41F 23/00*** | (2006.01) |
| ***B65H 5/00*** | (2006.01) |
| ***B65H 5/08*** | (2006.01) |
| ***B65H 7/00*** | (2006.01) |
| ***B65H 37/04*** | (2006.01) |
| ***B41F 33/00*** | (2006.01) |
| ***B41F 33/02*** | (2006.01) |
| ***B41F 33/16*** | (2006.01) |
| ***B41F 13/54*** | (2006.01) |
| ***B42C 19/08*** | (2006.01) |
| ***B65H 39/043*** | (2006.01) |
| ***B65H 43/04*** | (2006.01) |
| ***B65H 43/08*** | (2006.01) |
| ***B65H 39/055*** | (2006.01) |

(52) U.S. Cl.

CPC ..... *B41F 33/0009* (2013.01); *B41F 33/02* (2013.01); *B41F 33/16* (2013.01); *B42C 19/08* (2013.01); *B65H 5/006* (2013.01); *B65H 5/085* (2013.01); *B65H 7/00* (2013.01); *B65H 7/02* (2013.01); *B65H 7/04* (2013.01); *B65H 7/06* (2013.01); *B65H 7/14* (2013.01); *B65H 37/04* (2013.01); *B65H 39/043* (2013.01); *B65H 39/055* (2013.01); *B65H 43/04* (2013.01); *B65H 43/08* (2013.01); *B65H 2407/22* (2013.01); *B65H 2511/24* (2013.01); *B65H 2511/515* (2013.01); *B65H 2515/60* (2013.01); *B65H 2515/84* (2013.01); *B65H 2551/20* (2013.01); *B65H 2601/11* (2013.01); *B65H 2801/48* (2013.01)

(58) Field of Classification Search

CPC . B65H 7/06; B65H 7/14; B65H 43/02; B65H 43/04; B65H 5/006; B65H 2801/48

USPC ..... 270/58.01, 58.02, 58.04

See application file for complete search history.

(56) References Cited

U.S. PATENT DOCUMENTS

| | | | | |
|---|---|---|---|---|
| 4,471,954 | A * | 9/1984 | Bourg | B65H 7/125 270/58.03 |
| 5,629,672 | A * | 5/1997 | Brown | B65H 1/266 340/540 |
| 2008/0180513 | A1 | 7/2008 | Altenbach | |
| 2010/0063750 | A1 | 3/2010 | Floeder et al. | |
| 2016/0185563 | A1* | 6/2016 | Mutsuno | G03G 15/6582 270/58.02 |

OTHER PUBLICATIONS

Espacenet machine translation of EP1481598; obtained Mar. 8, 2018; http://translationportal.epo.org/emtp/translate/?ACTION=description-retrieval&COUNTRY=EP&ENGINE=google&FORMAT=docdb&KIND=A1&LOCALE=en_EP&NUMBER=1481598&OPS=ops.epo.org/3.2&SRCLANG=de&TRGLANG=en.*

Espacenet machine translation of EP1952986; obtained Mar. 8, 2018; http://translationportal.epo.org/emtp/translate/?ACTION=description-retrieval&COUNTRY=EP&ENGINE=google&FORMAT=docdb&KIND=A1&LOCALE=en_EP&NUMBER=1952986&OPS=ops.epo.org/3.2&SRCLANG=de&TRGLANG=en.*

European Search Report for EP 17 00 0753.

* cited by examiner

DEVICE AND METHOD FOR THE SUBSEQUENT PROCESSING OF PRINTED PRODUCTS

BACKGROUND

The present invention pertains to a device for the subsequent processing of printed products.

As used herein, "printed products" includes individual sheets or a collection of sheets or sections to be jointly processed by a transport device in order to modify the printed products. Known systems for the subsequent processing of printed products consist of a sequence of processing stations and usually feature several successive transport systems that transport the printed products to be processed to and from these processing stations. Revolving chains with corresponding transport element such as finger-shaped pushers or transport clamps are frequently used as transport systems, wherein each of the transport elements respectively accommodates a printed product such as, e.g., a printed sheet, a section, a book block or a partial block.

A common control is provided for coordinating the processes and motions of the transport systems and the processing stations in the required fashion. This control receives information from installed drives and sensors that serve for controlling and monitoring the respective systems and stations. Information on faulty processes or conditions received by the control is indicated with the aid of signal lamps that are spatially assigned to the respective processing stations. Furthermore, such processes and conditions, which are usually referred to as malfunctions, are visualized on the centralized or decentralized human-machine interface. This enables the operating personnel to detect and resolve the causative error.

It is also common practice to provide machine lighting systems that illuminate certain machine areas, particularly transport paths. These lighting systems enable the operating personnel to visually monitor the corresponding processes and therefore are usually arranged in the vicinity of inspection windows. These lighting systems are stationary and static and therefore not dependent on machine conditions and product conditions.

EP1952986A1 discloses a system for monitoring a device for processing printed products. The system is essentially formed by a lighting unit that can generate continuous light, as well as light flashes. In this case, the light flashes are synchronized with certain periodic motion sequences within the device for the subsequent processing of printed products such that these motions can be visually monitored by the operating personnel over a plurality of successive periods although the individual motion takes place too fast for the human eye.

This significantly simplifies the coordination of fast motions that are time-dependent on one another, particularly during the installation or set-up of the device. The strobe light also simplifies the analysis of processing errors in that recurring errors in very fast processes can be visually monitored during their development.

However, the thusly obtained information on the development of the error does not provide any useful reference to the current location of a faulty product. When the device stops after an error has occurred in order to enable the personnel to remove the faulty product, the location usually can only be roughly estimated, particularly at high transport speeds. The personnel is then forced to open the enclosure of the device at several locations until the faulty product is found. Several successive products have to be removed if the damage to the product caused by the malfunction cannot be directly detected visually.

SUMMARY

The present invention overcomes the disadvantages described above.

According to system and method embodiments of the invention, a lighting system extends along the transport path and is operatively connected to a controller. The lighting system is divided into individual lighting segments, with each lighting segment comprising at least one activatable light source. Each lighting segment is operatively connected to the controller for receiving a segment control signal whereby a light source in each individual lighting segment can be separately activated.

The controller is disclosed as operatively connected to sensors for receiving information on the condition of the device and/or the printed products. In response to the received information, the controller generates a control signal whereby a light source in each individual lighting segment is separately activated. The control signal for each lighting segment can include activating each light source to emit light of different colors and/or intensities.

BRIEF DESCRIPTION OF THE DRAWING

An exemplary embodiment of the inventive device and of the inventive method is described in greater detail below with reference to the drawing, in which.

DETAILED DESCRIPTION

Figure 1:
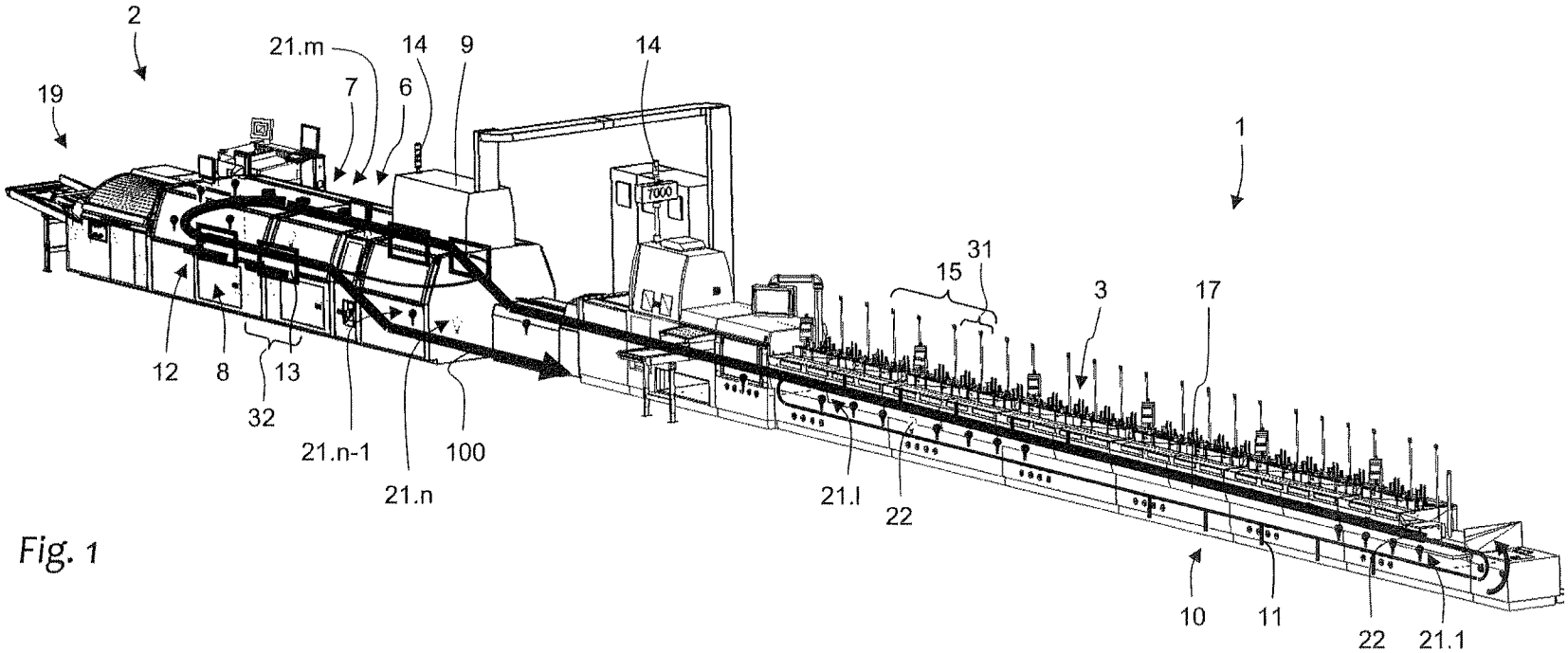
FIG. 1 shows equipment for a perfect-binding system with schematically illustrated product transport path and transport systems.

Equipment for a perfect-binding system illustrated in FIG. 1 includes a gathering machine 1, an adhesive binder 2 with a master control 9 and other not-shown machines and transport devices. The gathering machine 1 features a transport device in the form of an endlessly revolving gathering chain 10 with finger-shaped transport elements 11 that are equidistantly spaced apart from one another, wherein only a few of these finger-shaped transport elements 11 are illustrated in FIG. 1. The gathering chain 10 is arranged underneath a transport channel 18 for the book blocks or partial blocks 5. In this case, the finger-shaped transport elements 11 of the active chain segment protrude into this transport channel 18 in such a way that they push along the products 5 to be transported on their rear edge.

Several transport sections 15 on the frame of the fathering machine are arranged along the gathering chain 10 and respectively feature the same number of feeders 3. These feeders 3 respectively withdraw the bottom copy from a stack of printed products 4 stored in a magazine and cyclically feed these copies to the transport channel 18 in such a way that they are respectively placed in front of one of the finger-shaped transport elements 11 and the desired book block is formed in front of this finger-shaped transport element 11 in the form of a collection 5 during the course of the transport.

The thusly gathered collections 5 are individually transferred to the transport system 12 of the adhesive binder 2 along the transport path 100 drawn with bold lines in FIG.

1. This transport system consists of a chain that endlessly revolves in a horizontal plane and features equidistantly spaced-apart transport clamps 13, not all of which are illustrated in FIG. 1. Each of these transport clamps 13 is suitable for respectively accommodating a gathered book block and for transporting this book block through the processing stations 6, 7, and 8 of the adhesive binder 2 in a clamped fashion such that its spine downwardly protrudes from the clamp 13. In this case, the transport clamps 13 initially pass through a spine milling station 6 that exposes the individual sheet edges of the book block and produces a plane block spine. The transport clamps then pass through a glue application device 7, in which glue is applied on the block spine and the adjacent lateral areas.

A cover feeder 19 feeds a cover to the book block as needed after it has passed through the deflection area of the clamp-type transport system 12, wherein the cover is pressed on the areas of the book block provided with glue in a pressing device 8. As the transport path 100 continues, the transport clamps 13 successively open and release the respectively glued book blocks or brochures to not-shown downstream transport systems that transport the book blocks out of the adhesive binder and to other machines.

Figure 2:
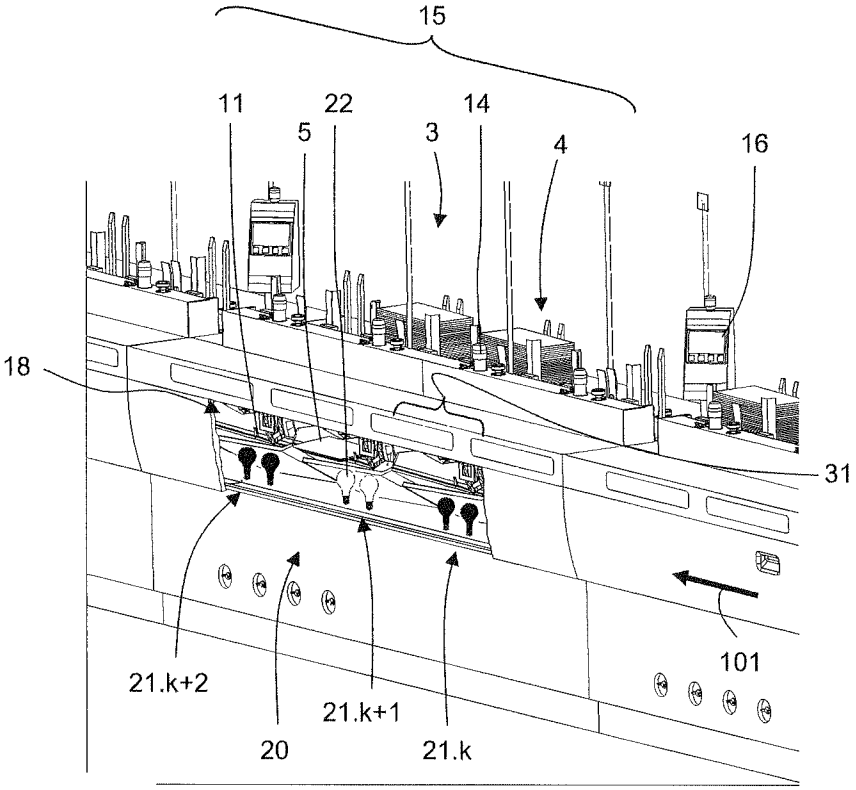
FIG. 2 shows a section of a gathering machine.

A lighting system 20 extends along the transport path 100 illustrated in FIGS. 1 and 2. It is divided into the lighting segments 21.1, . . . , 21.k, 21.k+1, 21.k+2, . . . , 21.n−1, 21.n. In the present example, each lighting segment corresponds with one stationary segment of the transport path. Transport path segment 31 is in the gathering machine 1 and transport path segment 32 is in the perfect binder 2. Their extent depends on the sections of the corresponding transport elements 11, 3. The exemplary section 15 spans three feeders 3, and three lighting segments are associated with each section 15 as well as three segments 31 of the transport path 100.

Each of these lighting segments 21.1, . . . , 21.n features a plurality of lighting sources 22, one of which respectively is schematically illustrated in FIG. 1 and two of which respectively are schematically illustrated in FIG. 2. Only selected lighting segments are respectively illustrated in FIG. 1 and FIG. 2 in order to provide a better overview. A given plurality of lighting sources can be embodied in a plurality of distinct lighting components (such as two bulbs) or in a single component that has multiple states, such as color and/or intensity.

The preferable lighting sources are light-emitting diodes that can generate light of different colors 201, 202, 203. The individual lighting segments 21.1, . . . , 21.n are connected to the control 9 of the perfect-binding system and can be controlled thereby independently of one another such that different lighting segments 21.1, . . . , 21.n can emit light of different colors 201, 202, 203 and different intensities 201, 211.

Figure 3:
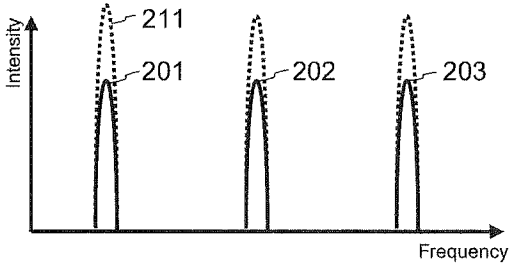
FIG. 3 shows a frequency spectrum of light sources.

The activated light color 201, 202, 203 and its intensity 201, 211 according to FIG. 3 are selected by the control 9 based on the expected condition of the product 5 located in the transport segment, which is assigned to the respective lighting segment 21.1, . . . , 21.n during a particular moment during operation. For this purpose, the control 9 utilizes information on the transport speeds of the transport systems 10, 12, as well as sensor signals that are interpreted as the time and the location, at which a potentially undesirable event or condition has occurred.

In the simplest case, the control 9 activates the lighting segments 21.1, . . . , 21.n, the assigned transport segments of which are in operation, such that they emit white light with comparatively low intensity in order to signal the readiness for production. As soon as the feeder 3 arranged upstream of the first transport segment feeds a bottom printed section 4 to the gathering chain 10 in the region of the first lighting segment 21.1 during the start of a production run, the control 9 activates this segment such that it emits blue light with comparatively low intensity 203 while the remaining lighting segments 21.2, . . . , 21.n still emit white light 201. As soon as the gathering chain 10 has advanced this printed section 4 by one segment, the color of this lighting segment 21.2 switches from white to blue 203.

If no following printed section 4 was in the meantime fed to the gathering chain 10 in the first lighting segment 21.1 by the first feeder 3, this first lighting segment 21.1 once again switches to white light 201. Consequently, all lighting segments 21.1, 21.3, . . . , 21.1 of the gathering machine 1 emit white light except for the second lighting segment 21.2, which emits blue light 203 as described above. In this way, the blue light travels along the transport path 100 synchronous with the withdrawn section 4. During uninterrupted production, this results in a blue illumination 203 of all lighting segments 21.1, . . . , 21.n while the first product passes through the device.

Such an illumination change in the presence of a product is particularly advantageous if a certain partial process has to be monitored by the personnel during the installation of the machine or a required error analysis and only one individual product or a short sequence of products is requested by the personnel for this purpose. The personnel is then able to easily track the transport of this product through the machine over a spatially long distance in order to thereby not miss the partial process to be monitored.

If the control 9 detects an error that does not require the exclusion of the corresponding product from the further production process, the control 9 assigns yellow light 202 to the respective lighting segment 21.1, . . . , 21.n. In this case, the decisive factor is the presence of a faulty product 4 within the respective lighting segment 21.1, . . . , 21.n as already explained above with reference to the error-free operation. The yellow light 202 once again travels along the further transport path 100 together with this faulty product 4. The operating personnel therefore has the option of potentially interrupting the production and purposefully removing the faulty product only. An example of such an error is the withdrawal of an incorrect section 4 by one of the feeders 3 due to faulty loading of its magazine.

Other errors respectively require the exclusion of the faulty product from the further production process or its manual removal. This may be the case, e.g., if the book block 5 is shifted in the transport clamp 13 by the spine milling device 6 within the adhesive binder 2 such that the book block 5 protrudes excessively from the clamp 13. In order to prevent damages to downstream processing stations 7, 8, the control 9 automatically stops the adhesive binder if such an error is detected. Since the stopping point is dependent on many parameters, it cannot be precisely predicted by the operating personnel. However, if the respective lighting segment 21.m, . . . , 21.n, in which the shifted book block 5 is located, switches to red light of high intensity 211, the attention of the operating personnel is drawn to this segment such that an expeditious removal and error correction can be achieved.

It is naturally also possible to use color coding other than those described above. An alternative color coding may also include "light off," i.e., a color or intensity variation in the form of a deactivation of a lighting segment. It is likewise possible, particularly during a machine standstill, to additionally identify the lighting segments 21.1, . . . , 21.n, in which a faulty product is expected, with a variation of the illumination in time, e.g. blinking or periodically increasing and decreasing the light intensity 201, 211, in order to draw the attention of the operating personnel to this transport segment even more purposefully.

In the context of the invention, it is irrelevant whether the presence of a certain product 4,5 in the respective lighting segment 21.1, . . . , 21.n is directly detected by means of a suitable sensor system such as a camera or the presence is expected based on a suitable model of the perfect-binding system. Such a model may consist, e.g., of a shift register of the control 9 that is synchronized with the relevant transport system 10,12.

The invention claimed is:

1. A device for processing printed products (4,5) comprising, a transport device (10,12) for transporting printed products (4) along a transport path (100), wherein said transport device includes a plurality of transport members (11,13) arranged behind one another in the transport direction (101) for respectively transporting a printed product (4) to be processed;

a plurality of processing devices (3,6,7,8) that are arranged along the transport path (100) for sequentially modifying the transported printed products (4);

a controller (9) operatively connected to the transport device (10,12) and at least one of the processing devices (3,6,7,8) for mutual communication of control signals;

a lighting system (20) extending along the transport path (100) and operatively connected to the controller (9); wherein the lighting system (20) is divided into individual lighting segments (21.1,21.n) along the transport path;

each lighting segment (21.1, . . . , 21.n) comprises at least one activatable light source (22); and each lighting segment (21.1, . . . , 21.n) is operatively connected to the controller (9) for receiving a segment control signal, wherein the controller (9) monitors the control signals for information on the presence and status of the printed products (4) and in response to said information, generates a control signal to separately activate a light source in each individual lighting segment (21.1, . . . , 21.n) to provide a visual indication of the current status of a printed product (4) in proximity to the activated lighting segment (21.1, . . . , 21.n).

2. The device according to claim 1, wherein the control signal for each lighting segment (21.1, . . . , 21.n) includes activating each light source to emit light of different colors (201,202,203) and/or intensities (201,211).

3. The device according to claim 1, wherein the lighting source (22) of the lighting segments (21.1, . . . , 21.n) respectively comprise at least one light-emitting diode.

4. The device according to claim 1, wherein the controller (9) monitors sensor signals of the device to receive information on the condition of the device (1,2) and/or the printed products (4) and said received information includes said sensor signals.

5. The device according to claim 1, wherein the transport path comprises a plurality of path segments, each path segment associated with at least one particular processing device and an individual product respectively assigned to be proceed in the particular device at a particular moment during operation of the device; and each lighting segment (21.1, . . . , 21.n) is associated with a respective segment of the transport path and is arranged such that the lighting source (22) of each lighting segment illuminates the respectively associated segment of the transport path (100) and/or the respectively assigned product (4,5).

6. The device according to claim 1, wherein the lighting segments (21.1, . . . , 21.n) are visible externally of the device during regular operation of the device.

7. The device according to claim 2, wherein the lighting source (22) of the lighting segments (21.1, . . . , 21.n) respectively comprise at least one light-emitting diode.

8. The device according to claim 2, wherein the controller (9) monitors sensor signals of the device to receive information on the condition of the device (1,2) and/or the printed products (4) and said received information includes said sensor signals.

9. The device according to claim 2, wherein the transport path comprises a plurality of path segments, each path segment associated with at least one particular processing device and an individual product respectively assigned to be proceed in the particular device at a particular moment during operation of the device; and each lighting segment (21.1, . . . , 21.n) is associated with a respective segment of the transport path and is arranged such that the lighting source (22) of each lighting segment illuminates the respectively associated segment of the transport path (100) and/or the respectively assigned product (4,5).

10. The device according to claim 8, wherein the transport path comprises a plurality of path segments, each path segment associated with at least one particular processing device and an individual product respectively assigned to be proceed in the particular device at a particular moment during operation of the device; and each lighting segment (21.1, . . . , 21.n) is associated with a respective segment of the transport path and is arranged such that the lighting source (22) of each lighting segment illuminates the respectively associated segment of the transport path (100) and/or the respectively assigned product (4,5).

11. A method for processing a sequence of printed products (4), comprising:

with a transport device (10,12), transporting spaced apart printed products (4) in a transport path (100) along a series of processing devices (3,6,7,8) in order to modify the printed products (4);

designating a plurality of lighting segments (21.1, . . . , 21.n) along the transport path, for segmented illumination of the transport path;

monitoring input signals for information on at least one of the presence and status of printed products (4) in a particular lighting segment (21.1, . . . , 21.n); and controlling illumination of lighting segments (21.1, . . . , 21.n) based upon said input signals to activate a light source (22) in the lighting segment (21.1, . . . , 21.n) commensurate with the condition of the printed product (4) located in the respective lighting segment.

12. The method according to claim 11, comprising controlling illumination of the respective lighting segment with input signals indicative of the presence of a product (4, 5) in a particular lighting segment (21.1, . . . , 21.n), and with output signals that activate a light source (22) in the lighting segment where the product is present.

13. The method according to claim 11, comprising controlling illumination of the respective lighting segment with input signals indicative of the condition of a product (4,5) in a particular lighting segment (21.1, . . . , 21.n), and with output signals that activate a light source (22) in the lighting segment commensurate with the condition of the product.

14. The method according to claim 11, wherein the output signals of the controller that activate a light source (22) in the lighting segment controls a color (201,202,203) of the light source (22).

15. The method according claim 11, wherein the output signals of the controller that activate a light source (22) in the lighting segment controls a color and an intensity of the light source (22).

16. The method according to claim 11, comprising controlling illumination of a plurality of the lighting segments with input signals indicative of the presence of a product (4,5) in a particular lighting segment (21.1, . . . , 21.n), and with output signals that activate a light source (22) in the lighting segment where the product is present; and controlling illumination of said plurality of the lighting segments with input signals indicative of the condition of a product (4,5) in a particular lighting segment (21.1, . . . , 21.n), and with output signals that activate a light source (22) in the lighting segment commensurate with the condition of the product.

17. The method according to claim 16, wherein the controller (9) activates a light source (22) in a respective lighting segment (21.1, . . . , 21.n)

a. with a first light color (201,211) as long as the condition "no product present" is present in this lighting segment (21.1, . . . , 21.n);

b. with a second light color (202) as long as the condition "proper product" is present in this lighting segment (21.1, . . . , 21.n); and c. with third light color (203) as long as the condition "faulty product" is present in this lighting segment (21.1, . . . , 21.n).

18. The method according to claim 11, wherein the designated plurality of lighting segments (21.1, . . . , 21.n) are arranged along the transport path (100);

the transport path is divided into a plurality of transport path segments; and the plurality of lighting segments correspond respectively to the plurality of transport path segments.

19. The method according to claim 18, comprising controlling illumination of the lighting segments with input signals indicative of the presence of a product (4,5) in a particular lighting segment (21.1, . . . , 21.n), and with output signals that activate a light source (22) in the lighting segment where the product is present; and controlling illumination of the lighting segments with input signals indicative of the condition of a product (4,5) in a particular lighting segment (21.1, . . . , 21.n), and with output signals that activate a light source (22) in the lighting segment commensurate with the condition of the product.

* * * * *